US006074454A

United States Patent [19]

Abrams et al.

[11] Patent Number: 6,074,454

[45] Date of Patent: Jun. 13, 2000

[54] LEAD-FREE FRANGIBLE BULLETS AND PROCESS FOR MAKING SAME

[75] Inventors: John T. Abrams, Raleigh; Anil V. Nadkarni, Chapel Hill, both of N.C.; Roy Kelly, Arlington, Va.

[73] Assignee: Delta Frangible Ammunition, LLC, Stafford, Va.

[21] Appl. No.: 08/678,776

[22] Filed: Jul. 11, 1996

[51] Int. Cl.[7] ..... F42B 8/14; F42B 12/74; C22C 1/04; C22C 1/09

[52] U.S. Cl. ..... 75/247; 75/231; 75/232; 75/233; 75/235; 75/236; 75/237; 75/238; 75/244; 75/252; 75/254; 102/506; 102/517; 102/529; 419/2; 419/28; 419/29; 419/38; 419/47; 419/56; 419/58; 419/59

[58] Field of Search ..... 75/231–233, 235–238, 75/244, 247, 252, 254; 419/2, 29, 38, 47, 28, 56, 58, 59; 102/444, 459, 506, 514, 517, 448, 529

[56] References Cited

U.S. PATENT DOCUMENTS

| | | | |
|---|---|---|---|
| 2,409,307 | 10/1946 | Patch et al. | 102/92.5 |
| 2,995,090 | 8/1961 | Daubenspeck | 102/91 |
| 3,123,003 | 3/1964 | Lange, Jr. | 102/91 |
| 4,005,660 | 2/1977 | Pichard | 102/92.1 |
| 4,165,692 | 8/1979 | Dufort et al. | 102/92.7 |
| 4,881,465 | 11/1989 | Hooper et al. | 102/501 |
| 4,949,645 | 8/1990 | Hayward et al. | 102/517 |
| 5,069,869 | 12/1991 | Nicolas et al. | 419/28 |
| 5,078,054 | 1/1992 | Sankaranarayanan et al. | 102/517 |
| 5,237,930 | 8/1993 | Belanger et al. | 102/529 |
| 5,279,787 | 1/1994 | Oltrogge | 419/38 |
| 5,399,187 | 3/1995 | Mravic et al. | 75/228 |
| 5,442,989 | 8/1995 | Anderson et al. | 86/20.12 |
| 5,527,376 | 6/1996 | Amick et al. | 75/246 |
| 5,616,642 | 4/1997 | West et al. | 524/439 |

FOREIGN PATENT DOCUMENTS

| | | | |
|---|---|---|---|
| 531389 | 1/1941 | United Kingdom . | |
| 2 278423A | 11/1994 | United Kingdom | 102/515 |

OTHER PUBLICATIONS

ASM Handbook, vol. 7, Powder Metallurgy pp. 798–801, 121–122, 710–716, 802–813, 1984.

Condensed Chemical Dictionary, Tenth Ed., 1981, pp. 147, 1981.

*Primary Examiner*—Daniel J. Jenkins

*Attorney, Agent, or Firm*—Kalow Springut & Bressler LLP

[57] ABSTRACT

The invention relates to bullets having increased frangibility (or which can be easily fragmented) and to materials and processes for the manufacture of such bullets. The bullets of the present invention are typically made from copper or copper alloy powders (including brass, bronze and dispersion strengthened copper) which are pressed and then sintered under conditions so as to obtain bullets with the desired level of frangibility. In preferred embodiments of the invention, the bullets also contain several additives that increase or decrease their frangibility.

66 Claims, 3 Drawing Sheets

9 MM BULLET - NOMINAL DIMENSIONS

9 MM BULLET - NOMINAL DIMENSIONS

.40 CALIBER BULLET - NOMINAL DIMENSIONS

FRANGIBLE BULLET TEST SETUP

LEAD-FREE FRANGIBLE BULLETS AND PROCESS FOR MAKING SAME

BACKGROUND OF THE INVENTION

Traditionally bullets for small arms ammunition have been manufactured from lead and lead alloys. The major advantages of lead as a bullet material are its relatively low cost, high density and high ductility. The high density of lead has been particularly important to bullet design because the energy generated by the weight of a bullet is critical to the proper functioning of modern semi-automatic and automatic weapons, the in-flight stability of the round, and the terminal effects of the bullet.

The highly toxic nature of lead, however, and its propensity to fume and generate airborne particulate, place the shooter at an extreme health risk. The more a range is used, the more lead residue builds up, and the greater the resulting lead fume and lead dust pollution (particularly for indoor ranges). Moreover, the lead bullet residue left in the earthen berm of outdoor ranges can leach into the soil and contaminate water tables. In order for indoor ranges to operate safely, they require extensive and expensive air filtration systems, and both indoor and outdoor ranges require constant de-leading. These clean up operations are time consuming, costly and repetitive. Accordingly, there is a great need for lead-free bullets.

Additionally, personnel at range operations are concerned with the ricochet potential and the likelihood of causing "back-splatter" of the training ammunition. Back-splatter is a descriptive term for the bullet debris that bounces back in the direction of the shooter after a bullet impacts on a hard surface, such as steel targets or backstops. Ricochets present a significant hazard to individuals, equipment and structures in and around live firing ranges. A ricochet can be caused by a glancing impact by a bullet on almost any medium. Back-splatter presents a significant danger to shooters, training personnel standing on or around the firing line and observers. When a bullet strikes a hard surface at or near right angles, the bullet will either break apart or deform. There is still energy in the bullet mass, however, and that mass and its energy must go somewhere. Since the target material or backstop is impenetrable, the mass bounces back in the direction of the shooter.

It is believed that a key way to minimizing the risk of both ricochet and back-splatter is to maximize the frangibility of the bullet. By designing the bullet to fracture into small pieces, one reduces the mass of each fragment, in turn reducing the overall destructive energy remaining in the fragments.

Several prior art patents disclose materials and methods for making non-toxic or frangible bullets or projectiles. For example, U.S. Pat. No. 5,442,989 to Anderson discloses projectiles wherein the casing is frangible and made out of molded stainless steel powder or a stainless steel+pure iron powder mix with up to 2% by weight of graphite. The casing encloses a penetrator rod made of a hard material such as tungsten or tungsten carbide. This projectile is mainly for 20–35 mm cannons to engage targets such as armored vehicles, trucks, buildings, ships, etc. Upon impact against the target, the casing produces fragments which are thrown in all directions with great energy while the penetrator rod pierces the target.

U.S. Pat. No. 4,165,692 to Dufort discloses a projectile with a brittle sintered metal casing having a hollow interior chamber defined by a tapering helix with sharp edge stress risers which provide fault lines and cause the projectile to break up into fragments upon impact against a hard surface. The casing is made of pressed iron powder which is then sintered. This projectile is also designed for large caliber rounds such as 20 mm cannon shots.

U.S. Pat. No. 5,399,187 to Mravic et. al. discloses a lead-free bullet which comprises sintered composite having one or more high density powders selected from tungsten, tungsten carbide, ferrotungsten, etc., and a lower density constituent selected from tin, zinc, iron, copper or a plastic matrix material. These composite powders are pressed and sintered. The high density constituent allows bullet densities approaching 9 g/cm$^3$.

U.S. Pat. No. 5,078,054 to Sankaranarayanan et. al. discloses a frangible projectile comprising a body formed from iron powder with 2 to 5% by weight of graphite or iron with 3 to 7% by weight of $Al_2O_3$. The powders are compacted by cold pressing in a die or isostatic pressing, and then sintered.

U.S. Pat. No. 5,237,930 to Belanger et. al. discloses a frangible practice ammunition comprising compacted mixture of fine copper powder and a thermoplastic resin selected from nylon 11 and nylon 12. The copper content is up to about 93% by weight. The bullets are made by injection molding and are limited to densities of about 5.7 g/cm$^3$. A typical 9 mm bullet only weighs about 85 grains.

None of the above discussed patents disclose or suggest lead-free, frangible bullets made of predominately copper with densities approaching that of conventional bullets. An objective of this invention is to provide a range of lead-free frangible bullets, optimized for frangibility, which will eliminate the lead fumes and dust hazard to the shooter while also minimizing the ricochet and back-splatter hazards. A further objective is to provide a low cost material and process for making such a bullet. Yet another objective is to provide a bullet with a weight (hence density) as high and as close to the conventional lead bullet as possible so that the recoil and the firing characteristics closely resemble those of conventional lead bullets. Yet another objective is to reduce the risk of lead residues leaching into the soil and water table in and around shooting ranges.

SUMMARY OF THE INVENTION

The invention relates to bullets having increased frangibility (or which can be easily fragmented) and to powder materials and processes for the manufacture of such bullets. The bullets of the present invention are made from copper or copper alloy powders, including brass, bronze and dispersion strengthened copper. In preferred embodiments of the invention, the bullets also contain several additives that increase or decrease their frangibility. Additionally, the invention provides a simple low cost process to make bullets that is amenable to mass production via automation.

DETAILED DESCRIPTION OF THE PREFERRED EMBODIMENTS

Figure 1:
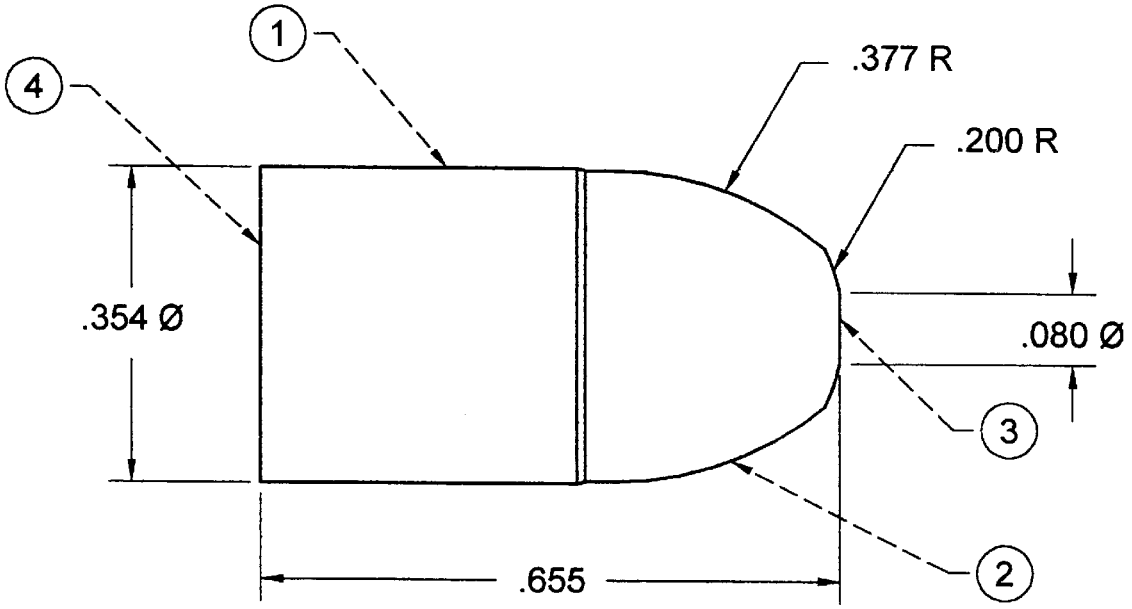
FIG. 1—shows a side elevation view of a typical 9 mm bullet.

The embodiments described in this section and illustrated in the drawings are intended as examples only and are not to be construed as limiting. In fact there are hundreds of bullet designs (at least) that could be made using the materials and the processes described in this disclosure. Moreover, the present disclosure is not intended as a treatise on bullet manufacturing and readers are referred to appropriate, available texts in the field for additional and detailed information on bullet manufacture and other aspects of practicing the invention.

Figure 2:
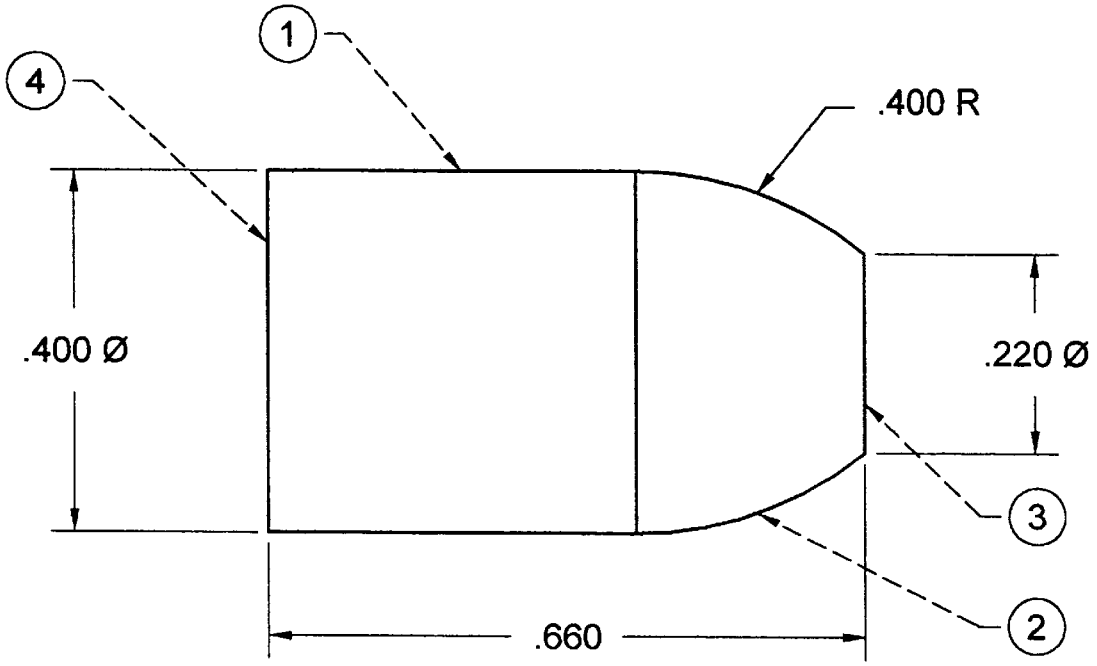
FIG. 2—shows a side elevation view of a typical 40 caliber bullet.

Referring to FIGS. 1 and 2, typical bullets have a cylindrical body (1) with a tapered nose portion (2). The tip of the nose (3) can have various shapes, e.g., it can be flat as shown in FIG. 2, radiused as in FIG. 1 or spherical for better aerodynamics. The base (4) can be flat or have a boat tail on it or be in other shapes.

Copper is the preferred material of choice for making the bullets of this invention. It is non-toxic and has a reasonably high density—8.96 g/cm$^3$ vs. 11.3 g/cm$^3$ for lead. Copper powder technologies offer ways to make the bullets frangible; the metal is otherwise very ductile and will deform excessively and ricochet upon impact against a hard surface. The preferred process to make the bullets of this invention involves first blending the powder with a suitable lubricant, typically a stearate or wax, and then cold compacting the powder in a die at a pressure that produces a part having a green strength sufficient to permit handling of the part without chipping. The density of the compacted part is adjusted to provide sufficient interconnected porosity to allow for the lubricant vapor to escape during subsequent sintering treatment.

The bullets are then preferably sintered by heating in a protective atmosphere to prevent oxidation. The sintering can be done in a belt furnace which has three zones. The first zone called the "preheat zone" is set to a temperature sufficient to burn the lubricant off, typically 1000–1200° F. The second zone called the "high heat" zone is set to the sintering temperature, typically the 1500–1900° F. range, the exact temperature depending on the material and the frangibility required. The third zone called the "cool zone" typically has a water jacket surrounding it which allows the bullets to be cooled to room temperature in a protective atmosphere. The sintering time is adjusted by controlling the belt speed. The bullets may be repressed or coined after the sintering treatment to increase their density further. This allows production of heavier bullets by using a longer preform and yet keeping the overall dimensions of the final bullets the same. Optionally, the bullets may be resintered if necessary to provide higher ductility or reduced frangibility.

Copper powder pressed to a density between 7.5 to 8.5 g/cm$^3$, preferably about 8.0 g/cm$^3$ and sintered at 1500 to 1900° F., preferably about 1700° F., has been found to have excellent firing characteristics and frangibility. Lower density and lower sintering temperature increase the frangibility while higher density and higher sintering temperature increase the ductility. A delicate balance must be struck between frangibility and ductility. The bullets must have sufficient ductility to withstand the firing operation without breaking up in the barrel of the gun or in flight up to the target. The bullet must also have sufficient frangibility so that it breaks up into small pieces upon impact against a hard surface.

It must be noted that different users of ammunition may prefer different degrees of frangibility. Some prefer to have complete breakup into powder to eliminate any ricochet or back-splatter and minimum penetration of the steel backstop while others will require retention of base pieces sufficiently large to preserve the rifling marks to assist in identifying the weapon which fired the bullet. Some others may prefer breakup into small pieces rather than powder to minimize airborne particles, and at the same time also minimize the ricochet potential.

The technology disclosed in this invention can accommodate most, if not all, of the frangibility requirements. As mentioned above, one way to control frangibility is through control of density, sintering temperature and sintering time. Another way is to use additives to the copper powder. Several elements or compounds can be added to the copper powder to increase or decrease frangibility and reduce penetration of and damage to range backstops. One of the objects of these additives is to coat the copper powder particles with inert second phases and thus partially impede the sintering process so that the bonds formed between the particles are embrittled. One group of additives are oxides such as $Al_2O_3$, $SiO_2$, $TiO_2$, MgO, $MoO_3$, etc. These may be added in powder form and blended or mechanically milled with the copper powder, or chemically formed by processes such as internal oxidation. One particular embodiment of this invention is to use a commercial $Al_2O_3$ Dispersion Strengthened Copper (DSC) produced by the internal oxidation process. As the examples will show, the DSC material and copper with mixed $SiO_2$ powder produced bullets with excellent firing characteristics and increased frangibility. Surprisingly, $MoO_3$ addition decreased frangibility.

Another group of additives is solid lubricants such as graphite, $MoS_2$, MnS, $CaF_2$, etc. As the examples will show, the bullets made using graphite as an additive showed good firing characteristics and increased frangibility, while $MoS_2$ addition decreased frangibility.

Yet another group of additives is nitrides such as BN, SiN, AlN, etc. Boron nitride in hexagonal crystallographic form (HBN) is preferred as this behaves much like graphite and acts as a solid lubricant. Bullets made with HBN as an additive have good firing characteristics and increased frangibility.

The additives mentioned above can be used in combinations as well. For example, bullets made with graphite and $SiO_2$ additions show good firing characteristics and increased frangibility.

Additionally, carbides such as WC, SiC, TiC, NbC, etc., and borides such as $TiB_2$, $ZrB_2$, $CaB_6$ may also be used to increase the frangibility.

Common copper alloy powders such as brass and bronze can also be used to make the bullets of this invention. These alloys are harder than copper and thus need to be pressed at higher pressures. Lower sintering temperatures must be used for these alloys, as brass loses zinc by vaporization while the bronze produces lower melting phases. Recommended sintering temperatures for the bullets of this invention are 1500 to 1700° F. Some of the additives described above for copper can also be used for brass and bronze powders if necessary to increase the frangibility. Mixtures of copper and zinc or copper and tin powders may also be used instead of prealloyed brass and bronze powders.

EXAMPLES

The following examples illustrate embodiments of the process and the lead-free frangible bullets of the present invention.

Example I

Five different grades of copper powder produced by SCM Metal Products, Inc. (hereinafter "SCM") were blended with a lubricant. These were assigned following blend numbers:

1) 99.75% 150RXM+0.25% Acrawax®C
2) 99.75% 150RXH 30 0.25% Acrawax®C
3) 99.75% 100RXM+0.25% Acrawax®C
4) 99.75% 100RXH+0.25% Acrawax®C
5) 99.75% FOS-WC+0.25% Acrawax®C Acrawax® is a trademark of Lonza Corporation. The generic name for Acrawax® is N,N'-ethylenebisstearamide, and its chemical family is alkyl amide. RXM, RXG, FOS-WS are grade designations of copper powder manufactured by SCM Metal Products, Inc. AL-25 is the grade designation for a dispersion strength copper material. Its generic designation in the Unified Number System (UNS) is C15725. Glid Cop® is the trademark for this material and is owned by SCM Metal Products, Inc.

About 115 grain (7.5 g) samples of the powder blend were pressed (molded) in a die to make the 9 mm bullets shown in FIG.-1. The bullets were sintered in a belt furnace under nitrogen. Density of bullets was determined using the water immersion technique.

Figure 3:
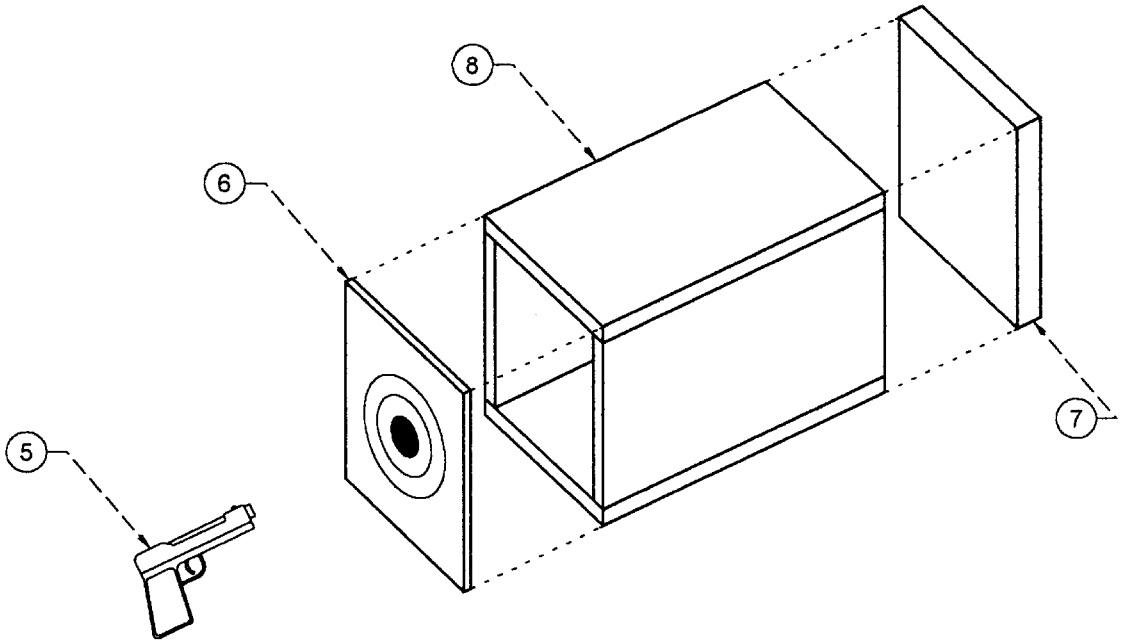
FIG. 3—shows a frangible bullet test setup.

The sintered bullets were loaded by Delta Frangible Ammunition LLC (hereinafter "Delta") into 9 mm Luger® primed cartridge cases using sufficient commercial smokeless propellant to produce velocities and pressures within the range normally encountered for 9 mm Luger® ammunition. The completed rounds were test fired. The test setup is shown in FIG.-3. Both instrumented test barrels and commercially available 9 mm pistols and sub-machine guns (5) were used. The absence of breakup in the barrel or in flight was determined by placing paper witness cards (6) along the flight of the bullet. Frangibility was determined by allowing the bullets to impact a thick (⅝ inch) steel backstop (7) placed perpendicular to the bullet's line of flight at the rear end of a wooden collection box (8). The bullets entered the collection box through a hole covered with a paper witness card. The fragments generated from the impact of the bullets against the steel plate were collected. Any intact "bases" were pulled out and the rest of the fragments were screened over a Tyler 14 mesh (1190 μm) screen. The component collected over the screen (>1190 μm) was labeled "chunks" and the remainder passing through the screen (<1190 μm) was labeled "powder". Each component was weighed and the weight percentage of each was calculated as a percentage of the total mass collected. In order to rate the different compositions of the invention as to their frangibility, weight factors were assigned to the three components as follows:

Powder: 60% or 0.60
Chunks: 30% or 0.30
Bases: 10% or 0.10

The "score" for each composition was calculated by multiplying the weight % of each component by its weight factor and adding the three numbers as follows:

$$\text{Score}=0.60\times\text{Wt. \% Powder}+0.30\times\text{Wt. \% Chunks}+0.10\times\text{Wt. \% Bases}$$

Frangibility ratings were then developed based on the score for each composition as follows:

| Score | Frangibility Rating |
|---|---|
| <15 | 1 |
| 16–25 | 2 |
| 26–35 | 3 |
| 36–45 | 4 |
| >45 | 5 |

The rating of 1, representing the lowest frangibility, had the highest weight % of bases while the rating of 5, representing the highest frangibility, had the highest weight % of powder.

Table-1 shows the pertinent processing data on the bullets and the firing test results. The data shows that densities over 8.2 g/cm$^3$ were achieved; this compares to 5.7 g/cm$^3$ typical of commercial injection molded copper-nylon bullets of the type described in U.S. Pat. No. 5,237,930 (the disclosure of which is incorporated by reference into the present disclosure). The higher densities allow heavier bullets to be produced without changing the overall dimensions; in fact it is possible to produce 120 grain bullets in the geometry shown in FIG.-1 which compares to 80–85 grain bullets typical of the copper-nylon type described above. These bullets thus more closely resemble the firing characteristics of conventional lead bullets now used in the field.

None of the bullets broke up in the gun barrel or flight, indicating good integrity. The data in Table 1 shows that the bullets made from the above copper powders had satisfactory frangibility. The 150RXH grade of copper had higher frangibility than the other grades examined. All these bullets did very little damage to the steel backstop.

Example II

This example illustrates the effect of oxide additions on frangibility. Copper powder grade 150RXM was used as the control material and all results were compared to the bullets made from this powder. Additions of oxides were made to this powder to determine their effects. In one experiment the FOS-WC copper powder was used. GlidCop® dispersion strengthened copper AL-25 (copper+0.5 wt. % $Al_2O_3$) grade powder produced by SCM was also used in one of the experiments. The following powder blends were made:

6) 99.70% 150RXM+0.05% $SiO_2$+0.25% Acrawax®C
7) 99.65% 150RXM+0.10% $SiO_2$+0.25% Acrawax®C
8) 99.65% 150RXM+0.10% $MoO_3$+0.25% Acrawax®C
9) 99.50% FOS-WC+0.25% $SiO_2$+0.25% Acrawax®C
10) 99.75% AL-25+0.25% Acrawax C Bullets were produced and test fired as described in Example I.

Table 2 shows the relevant processing and firing test data. The data shows that addition of $SiO_2$ does indeed increase frangibility. Blend 7 containing 0.10% $SiO_2$ made significantly more frangible bullets than the comparable Blend 1, while the addition of 0.05% $SiO_2$ in Blend 6 did not appear to have a significant effect on frangibility. The addition of 0.25% $SiO_2$ in Blend 9 coupled with the lower compaction pressure (lower density) and lower sintering temperature, on the other hand, made the bullet too frangible and it broke up before hitting the target. A higher compaction pressure (higher density) and higher sintering temperature may produce a bullet with sufficient integrity to survive firing. GlidCop® AL-25 which contains 0.5% $Al_2O_3$ (Blend 10) also made a bullet that survived the firing and broke up when it hit the target. This bullet was not as frangible as the control bullets of Blend 1, but this is believed to be due to the high sintering temperature normally used for GlidCop®. The frangibility of GlidCop® bullet could be increased further by reducing the sintering temperature or lowering the density. Surprisingly, the addition of $MoO_3$ (Blend 8) decreased the frangibility significantly; there was almost no powder recovered in the fragments. It is possible that the high partial pressure generated at sintering temperature by the dissociation of $MoO_3$ could have aided in the vapor transport of copper atoms, thus activating the sintering process and creating stronger more ductile bonds.

Example III

This example illustrates the effect of solid lubricants on frangibility. Graphite and $MoS_2$ were used as solid lubricants. Following blends were made:

11) 99.70% 150RXM+0.05% graphite+0.25% Acrawax C 12) 99.65% 150RXM+0.10% graphite+0.25% Acrawax C 13) 99.50% FOS-WC+0.25% graphite+0.25% Acrawax C 14) 99.65% 150RXM+0.10% $MoS_2$+0.25% Acrawax C Bullets were produced and test fired as described in Example I.

Table 3 shows the relevant processing and firing test data. The data shows that 0.05% graphite (Blend 11) does not change the frangibility, while 0.10% graphite (Blend 12) increases frangibility somewhat, as indicated by the higher score for this material. However, a higher amount of graphite is needed to increase frangibility significantly. Addition of 0.25% graphite to FOS-WC copper in Blend 13 made the bullet so frangible it broke up in the barrel, although this may have been due to the lower density and lower sintering temperature used. Higher density and higher sintering temperature would most likely produce a bullet with sufficient ductility to withstand firing. The addition of 0.10% $MoS_2$ (Blend 14) had the same surprising effect as observed with $MoO_3$ in that the frangibility decreased significantly. Here again, some effect of the additive on the sintering kinetics of copper is suspected.

Example IV

This example illustrates the effect of combined addition of an oxide and a solid lubricant. Blends were made with two different levels of $SiO_2$ and graphite added to the 150RXM powder. A blend was also made with graphite addition to AL-25 as follows:

15) 99.70% 150RXM+0.025% $SiO_2$+0.025% graphite+0.25% Acrawax C 16) 99.65% 150RXM+0.05% $SiO_2$+0.05% graphite+0.25% Acrawax C 17) 99.50% AL-25+0.25% graphite+0.25% Acrawax C Bullets were made and test fired as described in Example I.

Table 4 shows the relevant processing and firing test data. The data shows that a combined addition of graphite and $SiO_2$ had an effect similar to the addition of either of the components at the same level. A level of 0.05% (Blend 15) did not have a significant effect on the frangibility while a level of 0.10% (Blend 16) did have a significant effect. Addition of 0.25 graphite to GlidCop® AL-25 (Blend 17) made a bullet with sufficient ductility to survive firing, but significantly higher frangibility than plain AL-25 as in Blend 10.

Example V

This example illustrates the effect of a nitride addition on frangibility. A blend was made with an addition of hexagonal boron nitride (HBN) as follows:

18) 99.65% 150RXM+0.10% HBN+0.25% Acrawax C

Bullets were produced and test fired as described in Example I.

Table 5 shows the relevant processing and test firing data. HBN is not only a nitride, it has a crystallographic structure identical to graphite in that the hexagonal platelets slide over each other readily. Therefore, it is used as a solid lubricant. The frangibility data shows that an HBN addition had the same effect to that of graphite at the same level. At 0.10% addition (Blend 18), the frangibility was increased somewhat, but higher additions would be required to make a more significant impact on frangibility. Other nitrides including the cubic form of boron nitride (CBN) could also be used although the latter may be too abrasive to the tooling.

Example VI

This example illustrates that copper alloy powders can also be used to make bullets according to this invention. A 70:30 brass (copper:zinc) powder and a 90:10 bronze (copper:tin) powder were used. The following blends were made:

19) 99.75% 70:30 Brass+0.25% Acrawax C 20) 99.75% 90:10 Bronze+0.25% Acrawax C

Bullets were made and test fired as described in Example-1.

Table-6 shows the relevant processing and test firing data on these bullets. The data shows that the 70:30 brass powder is much harder than the 150RXM powder and gives a lower density. Both brass and bronze are very sensitive to sintering temperatures used. In both cases a 1500° F. sintering temperature (Blends 19A and 20A) produced a bullet that was too frangible and broke up before hitting the target and almost completely went back to powder. At 1600° F. the brass (Blend 19B) just slightly broke up before hitting the target and was still quite frangible. The bronze (Blend 20B), on the other hand, was quite ductile at this temperature and had a fairly low frangibility. At 1700° F. the brass (Blend 19C) bullet survived the firing and had a frangibility similar to the 150RXM bullet. It appears that the best sintering temperature for 70:30 brass bullets is in the 1600–1700° F. range and that for the 90:10 bronze bullet is between 1500–1600° F. Other brass and bronze compositions may require different sintering temperatures. Also if the additives mentioned above or other additives are used, the bullets may need different sintering temperatures or pressing conditions.

The invention has been described with respect to preferred embodiments. However, as those skilled in the art will recognize, modifications and variations in the specific details which have been described and illustrated (including blend compositions, sintering temperatures and compacting pressures, and bullet manufacturing techniques) may be resorted to without departing from the spirit and scope of the invention as defined in the appended claims.

TABLE 1

9 mm Bullet Processing and Test Results

| Blend No. | Mold Pressure (ksi) | Sinter Temp. (° F.) | Density (g/cm$^3$) | Breakup in Barrel or Flight | Powder <1190 μm (wt %) | Chunks >1190 μm (wt %) | Bases (wt %) | Score | Frang. Rating |
|---|---|---|---|---|---|---|---|---|---|
| 1A | 80 | 1700 | 8.26 | No | 12.6 | 19.1 | 68.3 | 20 | 2 |
| 1B | 88 | 1700 | 8.23 | No | 6.8 | 27.2 | 66.0 | 19 | 2 |
| 2A | 80 | 1700 | 8.29 | No | 17.0 | 57.0 | 26.1 | 30 | 3 |
| 2B | 88 | 1700 | 8.29 | No | 15.8 | 53.2 | 31.0 | 29 | 3 |
| 3 | 80 | 1700 | 8.24 | No | 1.4 | 32.4 | 66.2 | 17 | 2 |

TABLE 1-continued 9 mm Bullet Processing and Test Results

| Blend No. | Mold Pressure (ksi) | Sinter Temp. (° F.) | Density ($g/cm^3$) | Breakup in Barrel or Flight | Powder <1190 μm (wt %) | Chunks >1190 μm (wt %) | Bases (wt %) | Score | Frang. Rating |
|---|---|---|---|---|---|---|---|---|---|
| 4 | 80 | 1700 | 8.20 | No | 9.5 | 28.4 | 62.1 | 20 | 2 |
| 5 | 68 | 1500 | 8.02 | No | 5.4 | 23.3 | 71.3 | 17 | 2 |

TABLE 2

9 mm Bullet Processing and Test Results

| Blend No. | Mold Pressure (ksi) | Sinter Temp. (° F.) | Density ($g/cm^3$) | Breakup in Barrel or Flight | Powder <1190 μm (wt %) | Chunks >1190 μm (wt %) | Bases (wt %) | Score | Frang. Rating |
|---|---|---|---|---|---|---|---|---|---|
| 6 | 80 | 1700 | 8.23 | No | 10.4 | 20.2 | 69.4 | 19 | 2 |
| 7 | 80 | 1700 | 8.23 | No | 14.1 | 50.7 | 35.1 | 27 | 3 |
| 8 | 80 | 1700 | 8.27 | No | 0.4 | 18.2 | 81.4 | 14 | 1 |
| 9 | 68 | 1500 | 7.92 | Yes | 59.6 | 29.8 | 10.6 | 46 | 5 |
| 10 | 64 | 1860 | 8.30 | No | 5.4 | 33.6 | 61.0 | 19 | 2 |

TABLE 3

9 mm Bullet Processing and Test Results

| Blend No. | Mold Pressure (ksi) | Sinter Temp. (° F.) | Density ($g/cm^3$) | Breakup in Barrel or Flight | Powder <1190 μm (wt %) | Chunks >1190 μm (wt %) | Bases (wt %) | Score | Frang. Rating |
|---|---|---|---|---|---|---|---|---|---|
| 11 | 80 | 1700 | 8.25 | No | 8.7 | 19.5 | 71.8 | 18 | 2 |
| 12 | 80 | 1700 | 8.23 | No | 11.0 | 38.7 | 50.3 | 23 | 2 |
| 13 | 64 | 1500 | 8.02 | Yes | 53.4 | 34.4 | 12.2 | 44 | 4 |
| 14 | 80 | 1700 | 8.40 | No | 0.8 | 20.5 | 78.7 | 14 | 1 |

TABLE 4

9 mm Bullet Processing and Test Results

| Blend No. | Mold Pressure (ksi) | Sinter Temp. (° F.) | Density ($g/cm^3$) | Breakup in Barrel or Flight | Powder <1190 μm (wt %) | Chunks >1190 μm (wt %) | Bases (wt %) | Score | Frang. Rating |
|---|---|---|---|---|---|---|---|---|---|
| 15 | 80 | 1700 | 8.26 | No | 12 | 21 | 67 | 20 | 2 |
| 16 | 80 | 1700 | 8.20 | No | 15 | 53 | 32 | 28 | 3 |
| 17 | 64 | 1860 | 8.28 | No | 8.7 | 74.2 | 17.0 | 29 | 3 |

TABLE 5

9 mm Bullet Processing and Test Results

| Blend No. | Mold Pressure (ksi) | Sinter Temp. (° F.) | Density ($g/cm^3$) | Breakup in Barrel or Flight | Powder <1190 μm (wt %) | Chunks >1190 μm (wt %) | Bases (wt %) | Score | Frang. Rating |
|---|---|---|---|---|---|---|---|---|---|
| 18 | 80 | 1700 | 8.21 | No | 18 | 30 | 52 | 20 | 2 |

TABLE 6

9 mm Bullet Processing and Test Results

| Blend No. | Mold Pressure (ksi) | Sinter Temp. (° F.) | Density (g/cm$^3$) | Breakup in Barrel or Flight | Powder <1190 μm (wt %) | Chunks >1190 μm (wt %) | Bases (wt %) | Score | Frang. Rating |
|---|---|---|---|---|---|---|---|---|---|
| 19A | 88 | 1500 | 7.68 | Yes | 79 | 21 | 0 | 54 | 5 |
| 19B | 96 | 1606 | 7.76 | Yes | 26 | 69 | 5 | 37 | 4 |
| 19C | 88 | 1700 | 7.88 | No | 2 | 60 | 38 | 23 | 2 |
| 20A | 88 | 1500 | 8.24 | Yes | 80 | 20 | 0 | 54 | 5 |
| 20B | 88 | 1600 | 8.32 | No | 0 | 27 | 73 | 16 | 1 |

What is claimed is:

1. A frangible bullet comprising at least 60 percent by weight copper and manufactured by pressing a copper-containing powder in a die to form a pressed powder compact and subsequently sintering said pressed powder compact, wherein said sintering is partially impeded either (i) by the addition of a frangibility effecting additive to said powder, or (ii) through control of density of said pressed powder compact, or (iii) through control of sintering temperature, or sintering time, or any combination of the above; so as to produce a bullet capable of fragmenting upon impact with a target.

2. The bullet of claim 1 wherein the bullet is lead-free.

3. The bullet of claim 1 wherein the powder is a dispersion strengthened copper powder.

4. The bullet of claim 3 wherein the dispersion strengthened copper powder is made by internal oxidation of a dilute solid solution alloy of copper and a reactive element selected from the group consisting of Si, Al, Ti, and Mg.

5. Ammunition comprising the bullet of claim 1.

6. The bullet of claim 1, wherein the sintering is partially impeded by addition of a frangibility effecting additive to said powder; said additive being selected from the group consisting of an oxide, a solid lubricant, a nitride, a carbide, a boride, and a combination of any thereof.

7. The bullet of claim 1 wherein the sintering is partially impeded either (ii) through control of density of said pressed powder compact, or (iii) through control of sintering temperature, or sintering time, or any combination thereof.

8. The bullet of claim 7, wherein the powder is a dispersion strengthened copper powder.

9. The bullet of claim 8 wherein the dispersion strengthened copper powder is made by internal oxidation of a dilute solid solution alloy of copper and a reactive element selected from the group consisting of Si, Al, Ti, and Mg.

10. The bullet of claim 7, wherein the powder is a prealloyed brass containing from 5 to 40 percent by weight of zinc.

11. The bullet of claim 7, wherein the powder is a mixture of copper powder and from 5 to 40 percent by weight of zinc powder.

12. The bullet of claim 7 wherein the powder is a prealloyed bronze containing from 2 to 20 percent by weight of tin.

13. The bullet of claim 7 wherein the powder is a mixture of copper powder and from 2 to 20 percent by weight of tin powder.

14. The bullet of claim 7, wherein the powder comprises at least about 99.5 percent by weight copper.

15. The bullet of claim 7, wherein the powder is a mixture of about 90 percent by weight copper and about 10 percent by weight tin.

16. The bullet of claim 7, wherein the powder is a mixture of about 70 percent by weight copper and about 30 percent by weight zinc.

17. The bullet of claim 7, wherein the powder is a prealloyed bronze containing 10 percent by weight tin.

18. The bullet of claim 7, wherein the powder is a prealloyed brass containing 30 percent by weight zinc.

19. The bullet of claim 6 wherein the frangibility effecting additive comprises an oxide additive.

20. The bullet of claim 19 wherein the oxide additive is selected from the group consisting of $SiO_2$, $Al_2O_3$, $TiO_2$, MgO, $MoO_3$ and combinations thereof.

21. The bullet of claim 20 wherein the oxide additive is $SiO_2$, $Al_2O_3$, $TiO_2$, MgO or a combination thereof and the amount of oxide additive is from 0.05 to 1.0 percent by weight.

22. The bullet of claim 20 wherein the powder comprises from 0.05 to 0.50 percent by weight of $MoO_3$.

23. The bullet of claim 6 wherein the frangibility effecting additive comprises a solid lubricant additive.

24. The bullet of claim 23 wherein the solid lubricant additive is selected from the group consisting of graphite, $MoS_2$, MnS, $CaF_2$ and combinations thereof.

25. The bullet of claim 24 wherein the solid lubricant additive is graphite, MnS, $CaF_2$ or a combination thereof and the amount of solid lubricant additive is from 0.05 to 1.0 percent by weight.

26. The bullet of claim 24 wherein the powder comprises from 0.05 to 0.50 percent by weight of $MoS_2$.

27. The bullet of claim 6 wherein the frangibility effecting additive comprises a nitride additive.

28. The bullet of claim 27 wherein the nitride additive is selected from the group consisting of HBN, SiN, AlN and combinations thereof and the amount of nitride additive is from 0.05 to 1.0 percent by weight.

29. The bullet of claim 6 wherein the frangibility effecting additive comprises an oxide additive and a solid lubricant additive.

30. The bullet of claim 29 wherein the oxide additive is selected from the group consisting of $SiO_2$, $Al_2O_3$, $TiO_2$, and MgO and the solid lubricant additive is selected from the group consisting of graphite, MnS, and $CaF_2$ and the combined amount of oxide and solid lubricant additives is from 0.05 to 1.0 percent by weight.

31. The bullet of claim 6 wherein the frangibility effecting additive comprises a carbide additive.

32. The bullet of claim 31 wherein the carbide additive is selected from the group consisting of WC, SiC, TiC, NbC and combinations thereof and the amount of carbide additive is from 0.05 to 1.0 percent by weight.

33. The bullet of claim 6 wherein the frangibility effecting additive comprises a boride additive.

34. The bullet of claim 33 wherein the boride additive is selected from the group consisting of $TiB_2$, $ZrB_2$, $CaB_6$ and combinations thereof and the amount of boride additive is from 0.05 to 1.0 percent by weight.

35. The bullet of claim 6 wherein the powder is a prealloyed brass containing from 5 to 40 percent by weight of zinc.

36. The bullet of claim 6 wherein the powder is a mixture of copper powder and from 5 to 40 percent by weight of zinc powder.

37. The bullet of claim 6 wherein the powder is a prealloyed bronze containing from 2 to 20 percent by weight of tin.

38. The bullet of claim 6 wherein the powder is a mixture of copper powder and from 2 to 20 percent by weight of tin powder.

39. A method of making a frangible bullet which comprises pressing a powder containing at least 60 percent by weight copper in a die to form a pressed powder compact and subsequently sintering said pressed powder compact, wherein said sintering is partially impeded either (i) by the addition of a frangibility effecting additive to said powder, or (ii) through control of density of said pressed powder compact, or (iii) through control of sintering temperature, or sintering time, or any combination of the above; so as to produce a bullet capable of fragmenting upon impact with a target.

40. The method of claim 39, wherein the sintering is partially impeded either (ii) through control of density of said pressed powder compact, or (iii) through control of sintering temperature, or sintering time, or any combination thereof.

41. The method of claim 40 wherein the pressing of the powder is performed at a pressure ranging from 50 to 120 ksi.

42. The method of claim 41 wherein the pressing is done at a pressure ranging from 60 to 100 ksi.

43. The method of claim 40 wherein the sintering is performed in a protective atmosphere at a temperature ranging from about 1500 to about 1900° F. for a length of time ranging from about 10 to about 120 minutes.

44. The method of claim 43 wherein the sintering is done at a temperature of 1600 to 1800° F. when the powder is copper, between 1600 and 1700° F. when the powder is brass and between 1500 and 1600° F. when the powder is bronze.

45. The method of claim 43 wherein the protective atmosphere is nitrogen or a mixture of nitrogen and hydrogen or reaction products of a combusted hydrocarbon.

46. The method of claim 43 wherein the sintering time is between 15 and 45 minutes.

47. The method of claim 43 wherein the bullet is repressed after the sintering step.

48. The method of claim 47 wherein the bullet is resintered after repressing.

49. A powder useful for manufacturing a frangible item by pressing in a die and subsequently sintering, said powder comprising at least about 60 percent by weight copper and a frangibility effecting additive selected from the group consisting of an oxide, a solid lubricant, a nitride, a carbide, a boride, and combinations thereof.

50. A powder of claim 49, wherein the amount of the additive is from 0.05 to 1.0 percent by weight of the powder.

51. A powder of claim 49, wherein the additive is an oxide selected from the group consisting of $SiO_2$, $Al_2O_3$, $TiO_2$, MgO, $MoO_3$, and combinations thereof.

52. A powder of claim 51, wherein the amount of the oxide additive is from 0.05 to 1.0 percent by weight of the powder.

53. A powder of claim 49, wherein the additive is a solid lubricant selected from the group consisting of graphite, $MoS_2$, MnS, $CaF_2$, and combinations thereof.

54. A powder of claim 53, wherein the amount of the solid lubricant additive is from 0.05 to 1.0 percent by weight of the powder.

55. A powder of claim 49, wherein the additive is a nitride selected from the group consisting of HBN, SiN, AlN, and combinations thereof.

56. A powder of claim 35, wherein the amount of the nitride additive is from 0.05 to 1.0 percent by weight of the powder.

57. A powder of claim 35, wherein the additive is a carbide selected from the group consisting of WC, SiC, TiC, NbC, and combinations thereof.

58. A powder of claim 57, wherein the amount of the carbide additive is from 0.05 to 1.0 percent by weight of the powder.

59. A powder of claim 49, wherein the additive is a boride selected from the group consisting of $TiB_2$, $ZrB_2$, $CaB_6$, and combinations thereof.

60. A powder of claim 59, wherein the amount of the boride additive is from 0.05 to 1.0 percent by weight of the powder.

61. A powder of claim 49, wherein the additive is a combination of an oxide and a solid lubricant.

62. A powder of claim 61, wherein the oxide additive is selected from the group consisting of $SiO_2$, $Al_2O_3$, $TiO_2$ and MgO and the solid additive is selected from the group consisting of graphite, MnS, and $CaF_2$ and the combined amount of the oxide and solid lubricant additives is from 0.05 to 1.0 percent by weight.

63. A powder of claim 49, wherein the powder further contains from 5 to 40 percent by weight of zinc powder.

64. A powder of claim 49, wherein the powder further contains from 2 to 20 percent by weight of tin powder.

65. A powder of claim 49, wherein the powder comprises a copper alloy comprised of from 5 to 40 percent by weight of zinc.

66. A powder of claim 49, wherein the powder comprises a copper alloy comprised of from 2 to 20 percent by weight of tin.

* * * * *

US006074454C1

(12) EX PARTE REEXAMINATION CERTIFICATE (8897th)

United States Patent
Abrams et al.

(10) Number: US 6,074,454 C1
(45) Certificate Issued: Mar. 13, 2012

(54) LEAD-FREE FRANGIBLE BULLETS AND PROCESS FOR MAKING SAME

(75) Inventors: John T. Abrams, Raleigh, NC (US); Anil V. Nadkarni, Chapel Hill, NC (US); Roy Kelly, Arlington, VA (US)

(73) Assignee: Delta Frangible Ammunition, LLC, New York, NY (US)

Reexamination Request:
No. 90/009,288, Sep. 29, 2008

Reexamination Certificate for:

| | |
|---|---|
| Patent No.: | **6,074,454** |
| Issued: | **Jun. 13, 2000** |
| Appl. No.: | **08/678,776** |
| Filed: | **Jul. 11, 1996** |

(51) Int. Cl.

| | |
|---|---|
| ***F42B 12/00*** | (2006.01) |
| ***F42B 12/074*** | (2006.01) |
| ***C22C 1/004*** | (2006.01) |
| ***C22C 32/00*** | (2006.01) |

(52) U.S. Cl. ..... 75/247; 102/506; 102/517; 102/529; 419/28; 419/38; 419/56; 419/47; 419/59; 419/58; 419/29; 419/2; 75/238; 75/237; 75/236; 75/235; 75/233; 75/232; 75/231; 75/254; 75/252; 75/244

(58) Field of Classification Search ..... None
See application file for complete search history.

(56) References Cited

To view the complete listing of prior art documents cited during the proceeding for Reexamination Control Number 90/009,288, please refer to the USPTO's public Patent Application Information Retrieval (PAIR) system under the Display References tab.

*Primary Examiner*—Jerry D. Johnson

(57) ABSTRACT

The invention relates to bullets having increased frangibility (or which can be easily fragmented) and to materials and processes for the manufacture of such bullets. The bullets of the present invention are typically made from copper or copper alloy powders (including brass, bronze and dispersion strengthened copper) which are pressed and then sintered under conditions so as to obtain bullets with the desired level of frangibility. In preferred embodiments of the invention, the bullets also contain several additives that increase or decrease their frangibility.

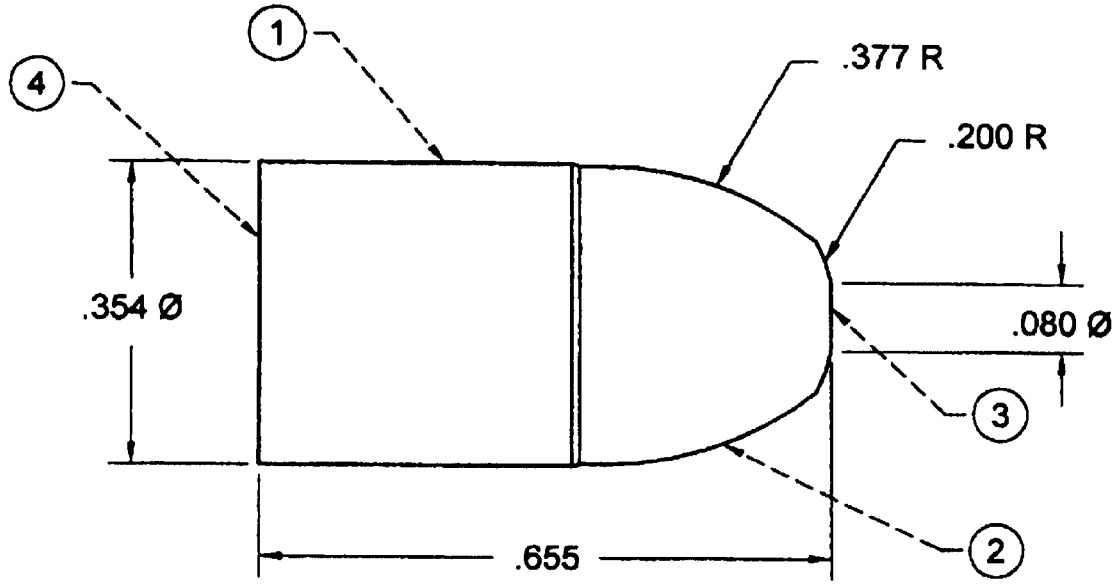

9 MM BULLET - NOMINAL DIMENSIONS

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1, 2, 5-7, 12-15, 23, 24, 38-42, 49, 50, 53, 54, 64 and 66 are cancelled.

Claims 3, 4, 8-11, 16-22, 25-37, 43-48, 51, 52, 55-63 and 65 were not reexamined.

* * * * *